United States Patent [19]

Ross, Jr. et al.

[11] 3,946,662

[45] Mar. 30, 1976

[54] MATERIAL RECEIVING AND COMPACTION SYSTEM AND APPARATUS THEREFOR

[75] Inventors: Thorvald S. Ross, Jr., Manchester; Leonard P. Entin, Wayland, both of Mass.

[73] Assignee: Ross Corporation, Beverly, Mass.

[22] Filed: July 23, 1973

[21] Appl. No.: 381,742

[52] U.S. Cl. ..... 100/240; 100/DIG. 2; 100/295; 141/73; 220/65; 241/99

[51] Int. Cl.[2] ..... B30B 15/06; B30B 1/04

[58] Field of Search ..... 100/214, 240, 295, DIG. 2; 241/99; 220/65; 141/73; 68/215; 259/116, 124; 53/124 B; 277/100; 403/69

[56] References Cited

UNITED STATES PATENTS

| | | | |
|---|---|---|---|
| 1,983,368 | 12/1934 | Hathorn | 277/100 |
| 2,135,404 | 11/1938 | Lofstrand | 241/99 |
| 2,559,196 | 7/1951 | Medved | 259/116 |
| 2,717,792 | 9/1955 | Pelley | 403/69 |
| 3,565,351 | 2/1971 | Ross | 241/99 |
| 3,675,810 | 7/1972 | Ross et al. | 220/65 |

*Primary Examiner*—Billy J. Wilhite
*Attorney, Agent, or Firm*—Kenway & Jenney

[57] ABSTRACT

A trash disposal system and apparatus therefor. A container having an opening at the top, a protective cover therefor loosely fitting and closing the opening, and means on either the container or cover requiring that the cover be centered on the container if the cover is to be removed therefrom. The cover has a ball and socket joint in its center, and a compacting tool such as a ram with an elongated shaft is snugly fit but freely slidable in the ball of the ball and socket joint, the ram having an enlarged head at its inner end and being swiveled with respect to the cover and the container.

19 Claims, 15 Drawing Figures

FIG. 1
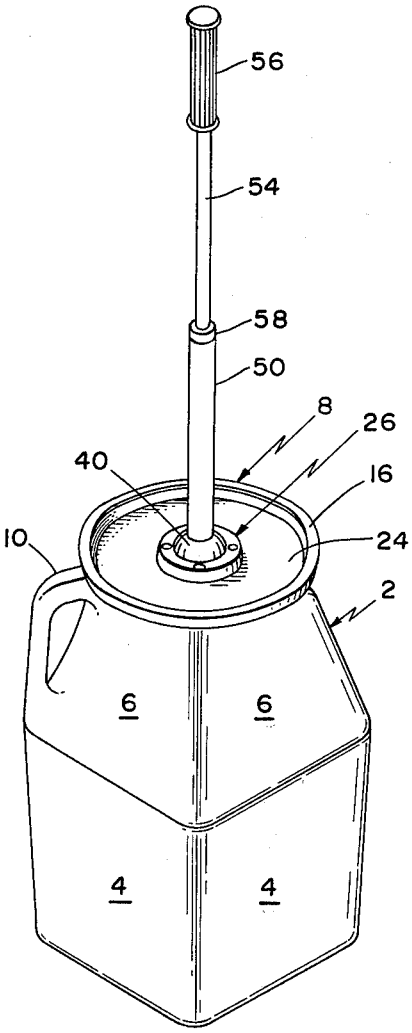
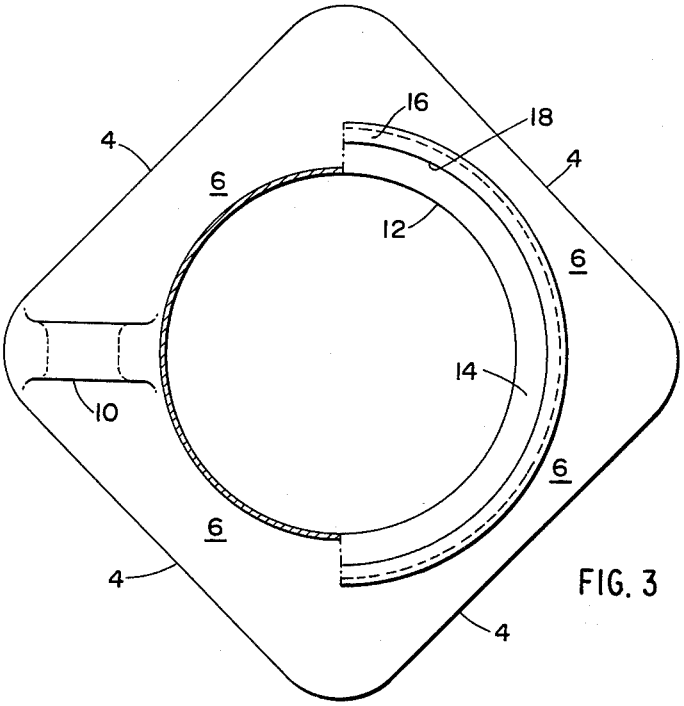
FIG. 3
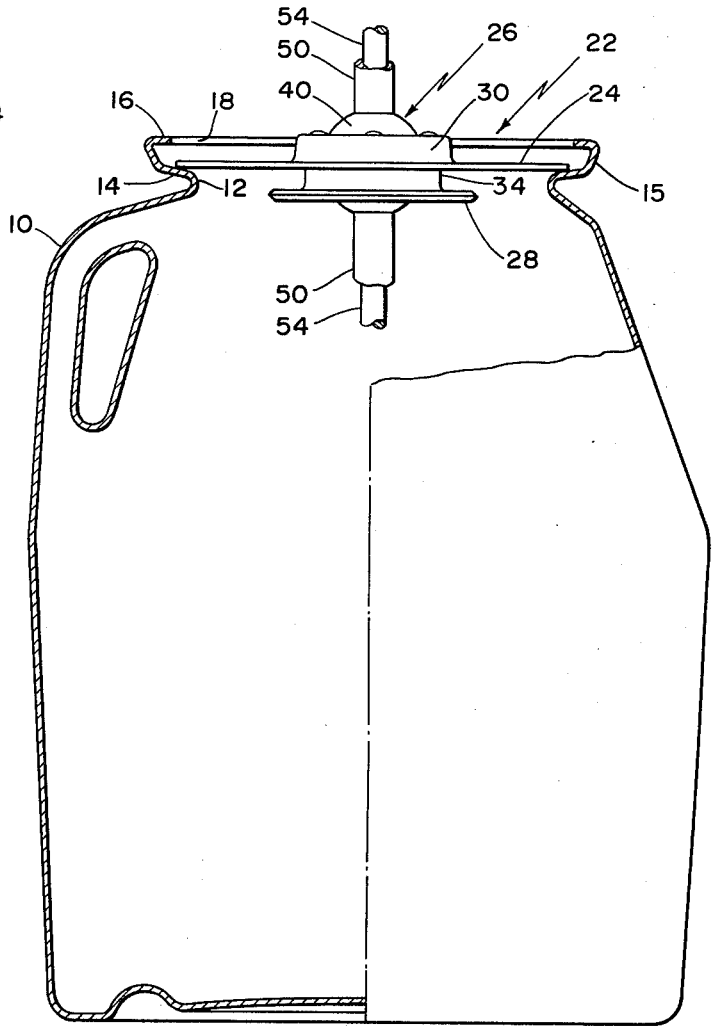
FIG. 2

FIG. 8
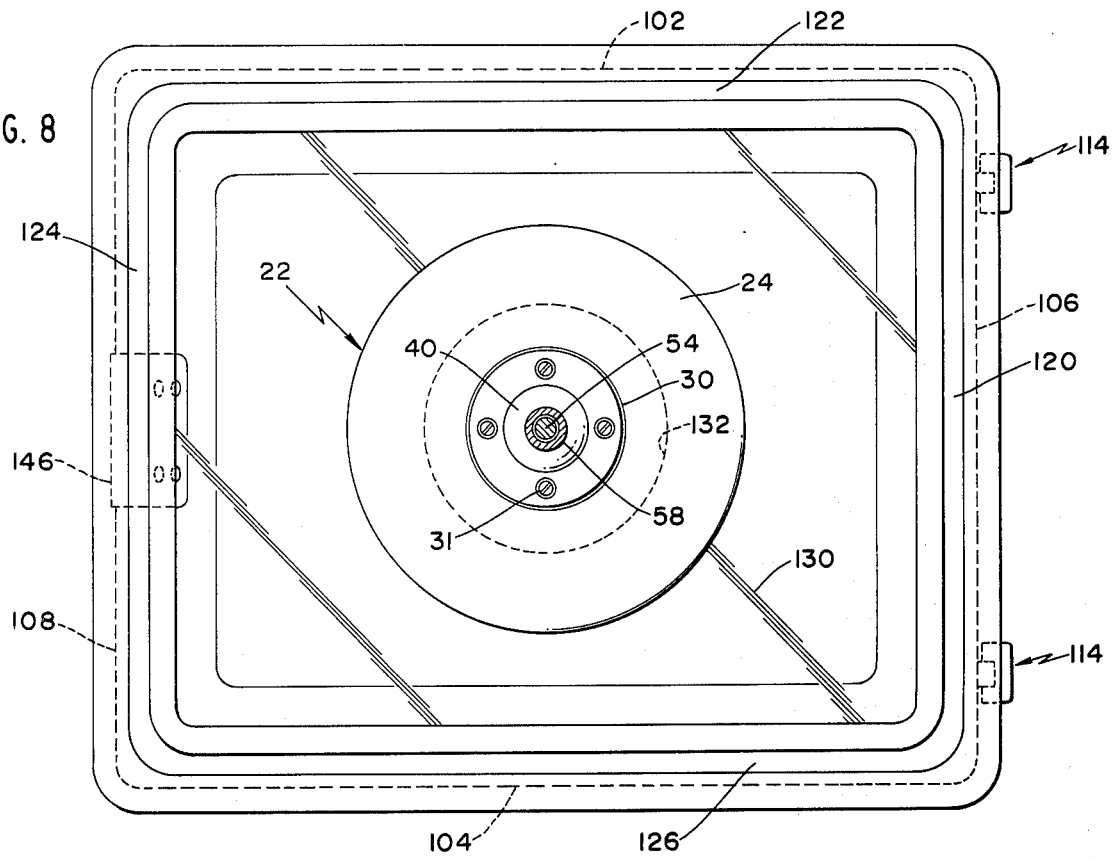
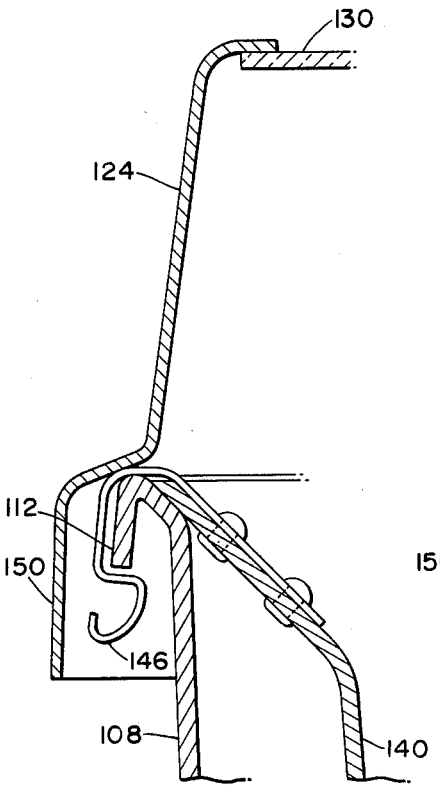
FIG. 9
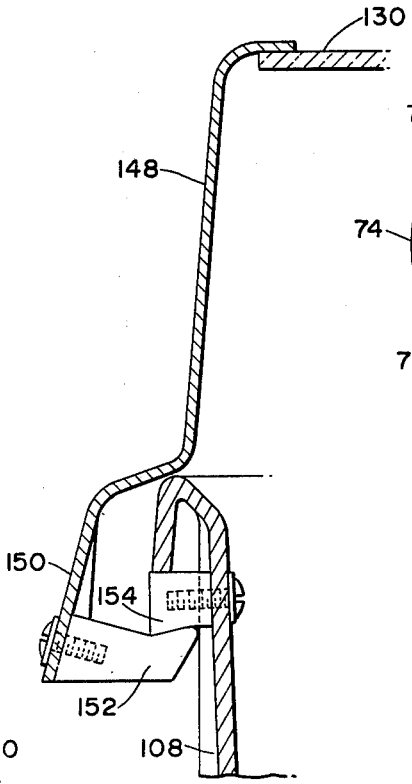
FIG. 10
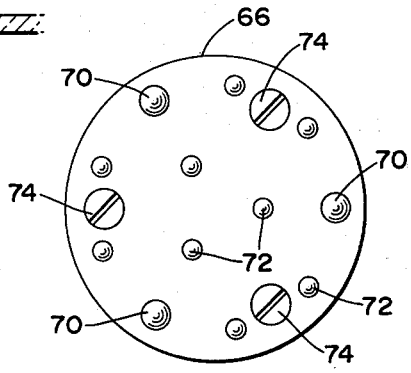
FIG. 11
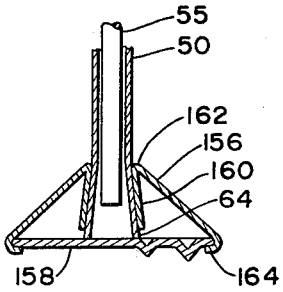
FIG. 12

MATERIAL RECEIVING AND COMPACTION SYSTEM AND APPARATUS THEREFOR

BACKGROUND OF THE INVENTION

Reference is made to copending application Ser. No. 138,482, now U.S. Pat. No. 3,779,157. That application describes and claims a receptacle for receiving material to be compacted, such as trash material, the latter being the usual household waste material such as paper, bottles, tin cans, etc. The receptacle has a cover, means for sealing the cover against the escape of flying particles of glass or other unwanted particles, and having inserted slidably through the cover of the receptacle a ram or impactor unit (compaction unit) with an enlarged head. Material is placed in the receptacle, and then the impactor or ram is used to crush or compact the material.

The apparatus of said application is a general purpose apparatus, and no provision is made for economically and specifically segregating the several types of material to be compacted either within such container or a plurality of containers. However, there is growing need for a system which is low enough in price for most families to buy, and which facilitates such segregation. To satisfy this need, the use of several containers, for the purposes of segregation and compaction, seems to be a convenient way, if the cost can be kept low. The general purpose apparatus of said application can be used that way, but is relatively expensive compared to the system and apparatus of this invention.

SUMMARY OF THE INVENTION

Accordingly, it is the purpose of this invention to provide a system (and units therefor) for the segregation and compaction of material such as household trash, one embodiment of the system utilizing relatively inexpensive containers in which the several materials such as different color bottles and cans may be put. Each container will be provided with a separate cover so as, for example, to prevent accidental entry thereinto by young children. However, a single compaction tool with a shield or cover which will fit each of the individual containers, is to be used with each container for the purpose of compaction, the shield or cover preventing the escape of flying particles of glass or other crushed materials. In another embodiment, bottles, cans, and paper may be compacted.

Accordingly, among the several objects of the invention may be noted the following:

One object of the invention is the provision of a container of relatively inexpensive but sturdy construction, open at the top but having means for closing the top, the closure means being removable at the will of the operator but unable to be detached from the container unless properly positioned thereon.

Another object of the invention is the provision of a container of the above kind, in which the closure element can move laterally on the container while still sealing the same, the closure element having a freely movable sealing member at the center thereof through which a compaction tool can freely slide and also swivel with respect to the container.

Yet another object of the invention is a container of the above types, in which the closure member with its ram may be removed from the container at the will of the user thereof at any time, in order for it to be used on other similar containers.

Still another object of the invention is the provision of a system in which containers of the above kinds are provided, and a single cover and its ram freely slidable therein may be used with any one of the containers interchangeably.

A further object of the invention is the provision of a combined cover and ram which may be safely used with more than one type of container, and having means for retaining the cover on its container.

Other objects and advantages will be in part obvious and in part pointed out hereinafter.

The invention accordingly comprises the elements and combinations of elements, features of construction, arrangements of parts, and manipulation of the apparatus all of which will be exemplified in the structures hereinafter set forth, and the scope of the application of which will be indicated in the appended claims.

In the accompanying drawings, in which several embodiments of the invention are disclosed.

FIG. 1 is an overall view of one embodiment of the invention.

FIG. 2 is a sectional elevation, in part, of the FIG. 1 embodiment.

FIG. 3 is a plan view, partly in section, of the FIG. 1 embodiment.

FIG. 8 is a plan view of the FIG. 7 embodiment.

FIG. 9 is a sectional elevation of a portion of the FIG. 7 embodiment, given in enlarged view to illustrate certain features of the invention.

FIG. 10 is a cross-sectional elevation of a fourth embodiment of the invention.

FIG. 11 is an end view of a compactor used in this invention.

FIG. 12 is an elevation of one end of an impacting tool, showing a fifth embodiment of the invention.

Throughout the drawings, similar reference characters indicate corresponding parts. Also, dimensions of certain of the parts as shown in the drawings may have been modified and/or exaggerated for the purposes of clarity of illustration and understanding of the invention.

Figure 4:
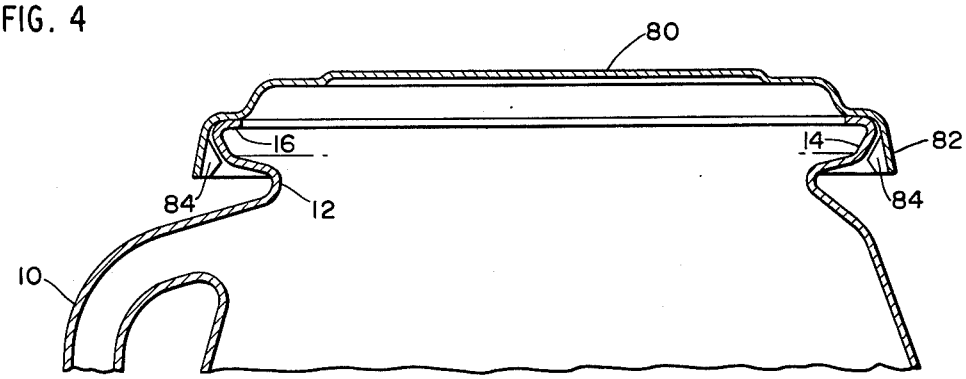
FIG. 4 is a view of a portion of the FIG. 1 embodiment, in cross-sectional elevation, given to show a separate, protective storage cover placed thereon.

Referring to FIGS. 1–3 for a description of a first embodiment of the invention, there is shown generally by numeral 2 a holder or container for receiving the material to be compacted, such as household trash, the container 2 being made of plastic of a strong durable type such as high density polyethylene blow molding grade, and having the four side walls 4. The container is generally rectangular or square shaped, but it could be cylindrical. The cross-section shape of the container is maintained approximately the same so that the walls are parallel up to a point about half way up the walls, and then the walls converge inwardly to meet at the generally circular rim portion indicated generally by numeral 8. Integrally attached preferably at one corner of the inwardly directed walls 6 is a handle 10. The container thus forms a bottle, and at the top has the opening 12, this opening being preferably round. From the opening 12, the top of the bottle flares outwardly to provide the sloping shoulder 14, and then bends upwardly and inwardly to provide flange 16. The inner periphery 18 of the flange is larger in diameter than the diameter of the opening 12.

A closure member indicated generally by numeral 22 provided, it being common to several embodiments of this invention. The closure member comprises a disc 24 of substantially rigid material (although it can be slightly flexible), and a swiveled seal at its center, the latter being a ball and socket joint indicated generally by numeral 26. Disc 24 is made of a molded synthetic resin of strong and durable nature, such as, for example, polycarbonate or high density polyethylene. It may be transparent. Dependent from the disc 24 is an outwardly extending flange indicated generally by numeral 28, the function of which will be disclosed below in connection with another embodiment. Flange 28 is smaller in diameter than the diameter of opening 12.

It will be noted that the diameter of the cover disc 24 is significantly greater than the diameter of the opening 12. Also, it is to be noted that the diameter of the disc 24 is slightly smaller than the inner diameter of the flange 18. As a result, unless the disc 24 is centered on the opening 12, it will be hindered in its removal from the container 2. However, since the diameter of the disc 24 is also less than the diameter of the outwardly turned shoulder 14, the disc 24 can move from side to side while still being held on the shoulder by flange 16, until the disc is centered on the container. However, the inner diameter of the wall 15 is small enough so that the disc 24 cannot move laterally far enough to create an opening into the container.

Figure 7:
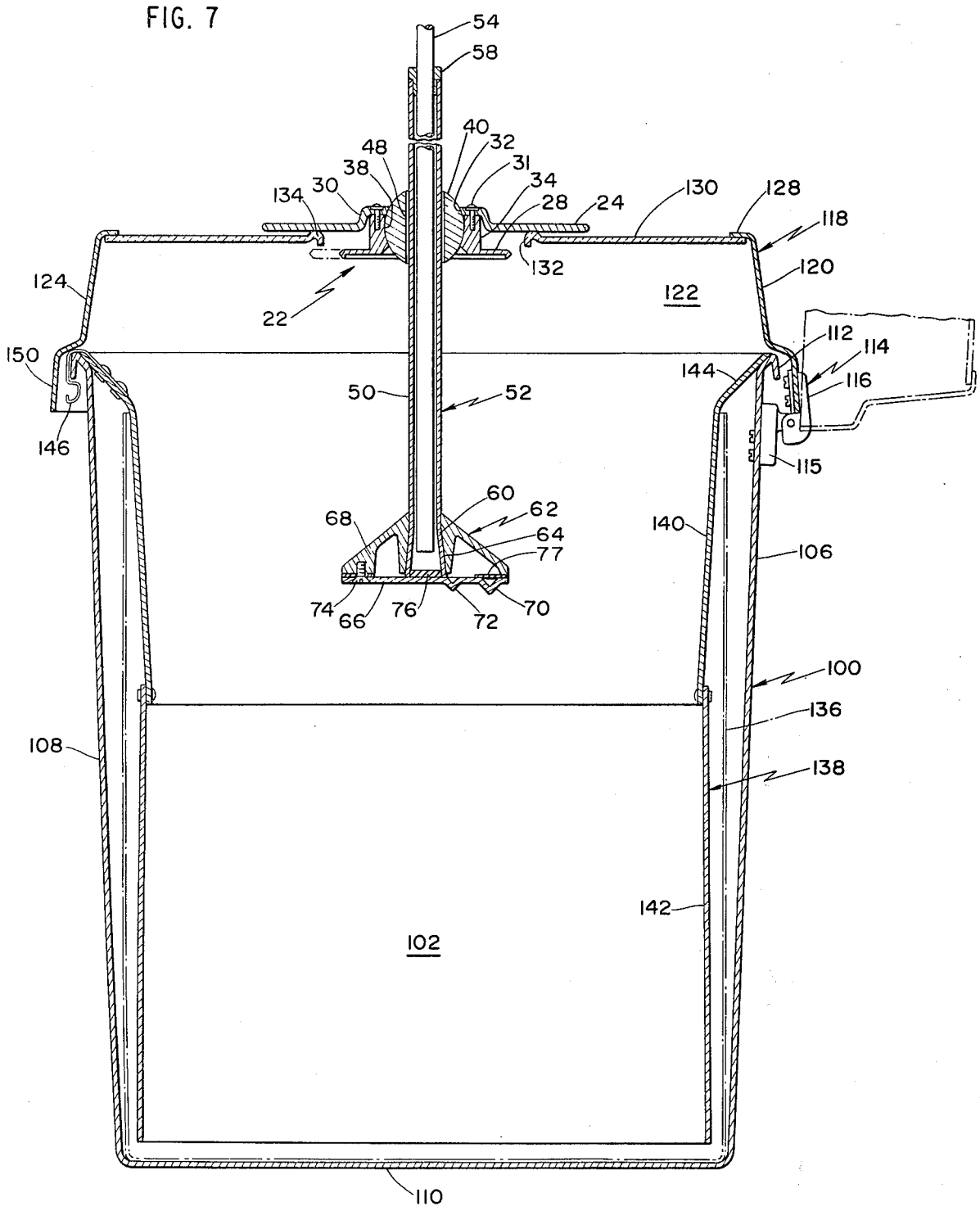
FIG. 7 is a sectional elevation of a third embodiment of the invention.

Referring now to FIG. 7, there is shown in detail, and in cross-section, the ball and socket swiveled aperture. Disc 24 is shown which is a substantially flat plate member and has boss 30 at the center thereof. Boss 30 is provided with a hole 32 in the center thereof for a purpose which will be described below. A downwardly depending collar 34 is attached to boss 30 by screws 31 and has the flange 28. Collar 34 has a partially spherical opening 38 in the center thereof forming a socket. Opening 32 in boss 30 partially closes opening 38 to retain ball 40 in the thus formed socket. Assembly is by inserting ball 40 in socket 38, and fastening collar 34 and boss 30 together.

Ball 40 is provided with a hole 48 through which smoothly slides the handle 50 of a ram indicated generally by numeral 52. The handle 50 is a hollow tube, within which slides shaft 54. Shaft 54 terminates at its upper end by a convenient handle portion 56 of conventional nature. A bushing 58 of conventional nature such as nylon or suitable plastic surrounds the shaft 54 and acts as a guide for the shaft's upward and downward motion.

Lower end 60 of the tubular handle flares outwardly as shown, to provide a taper lock engagement for the outwardly flaring cone shaped head portion 62. Head 62 comprises a shell preferably made of a durable metal. It is partially hollow, and has at its center a central sleeve 64 which is provided with a tapered hole matching the taper of end 60. The tapers may be any of the conventional tapers in order to provide a locking fit between the sleeve 64 and end 60.

The outer wall of the head 62, as shown, extends downwardly, and the head is closed by means of a steel plate 66 which is attached by screws 74 to suitable thickened portions or bosses 68 of the shell 62 and which are integrally molded parts of the inner wall of head 62. Plate 66 has formed in it the outwardly extending pressure points 70, 72 which are cone shaped, all as described in the aforesaid U.S. Pat. No. 3,565,351. When attached, plate 72 bears against the end of the tapered sleeve 60, thus locking the head 62 to the tapered end 60 of the handle. An impact pad 76 (such as rubber) is preferably provided on the plate 66 in order to receive the impact of the end of the shaft 54 when it is driven downwardly into the handle 50 in a compaction stroke. A gasket 77 may be used, if desired.

The ram is used as is the ram shown and claimed in U.S. Pat. No. 3,565,351. It differs structurally from the latter in several important aspects leading to economy of manufacture and ease of assembly.

The container 2 is intended to be one of a plurality of such containers. In view of the fact that these containers can be blow-molded from synthetic resin plastics, they will be relatively inexpensive. In addition, disc 24 and 28, collar 34 and ball 40, are all preferably made of strong synthetic resin plastic of low coefficient of friction such as high density polyethylene. Handle 50 is made of metal such as aluminum or steel.

As an example of use of the above embodiment, it is intended that a plurality of such containers 2 will be provided: for example, one for green bottles, one for brown bottles, one for uncolored bottles, (these being the common types of bottles used domestically); and, if desired, a fourth container can be used for metal articles (such as tin cans). In view of the fact that several containers will thus be used, it is preferred for reasons of economy that a single closure member 22 be used for all four containers, and moving it from container to container depending upon what is being compacted at the time. It therefore needs to be removable from the containers. However, it is also desired that when a closure element 22 is being used on a container, it not be readily moved away from the container during use, for example, during upstrokes of the ram or upward movements of handle 50 during positioning of the ram on material to be crushed. As indicated above, the inner diameter of overhanging flange 16 is just slightly larger than the disc 24, and this provides stop means for preventing the closure member 22 from lifting off the container during use, since the disc 24 will not stay centered with respect to flange 16 but will tend to move laterally. However, when it is desired to move the unit comprising the closure member 22 to another container, all that is necessary is to center the disc 24 in the flange 16, and then the entire unit (closure member and ram structure) can be lifted off.

During the use of one of the containers, it is desired to cover the others to prevent undesired access thereto, to retain crushed material, particularly those that contain shattered glass, and to prevent spillage if it is accidentally knocked over. Accordingly, (see FIG. 4) a cover 80 is provided as indicated. It is made of molded synthetic resin plastic of the general shape shown, and has a downwardly extending skirt 82. On the inner surface of the skirt are provided detents 84, these being, for example, three in number. They are shaped as shown, in order to engage the sloping shoulder 14 with a snap grip. Detents 84 may be molded as integral parts of the cover 80, or may be attached thereto by conventional adhesives suitable for the plastic used for the cover.

It is desired that at least a portion of the cover 80 be transparent so that the user of the apparatus can see immediately without taking off the cover, the particular container needed for a given color glass.

Figure 5:
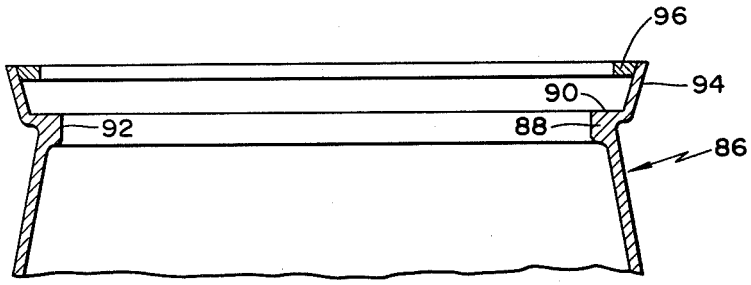
FIG. 5 is a view of a portion of a second embodiment of the invention, given in cross-sectional elevation.
Figure 6:
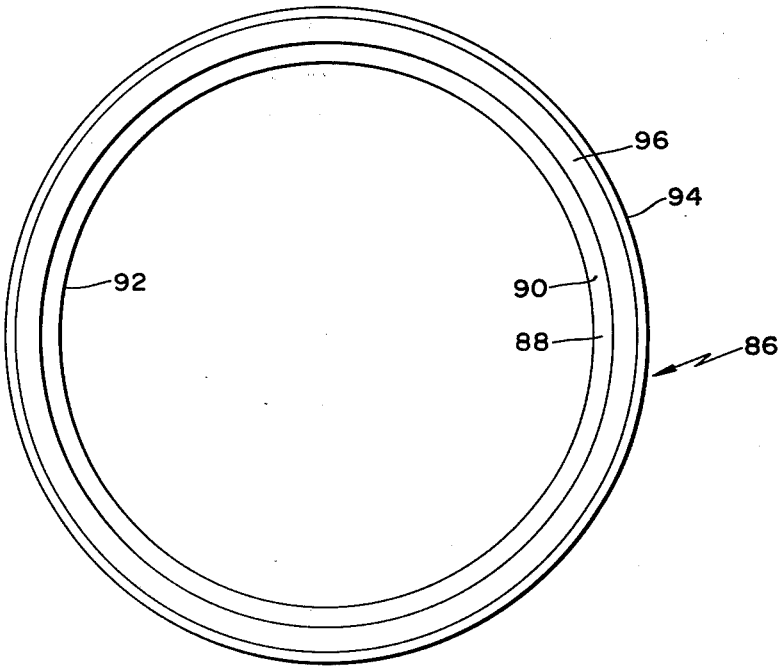
FIG. 6 is a plan view of the FIG. 5 embodiment.

Referring now to FIGS. 5 and 6, another embodiment of the invention is shown which is somewhat similar to the FIGS. 1–3 embodiment, except that the container, indicated generally by numeral 86, is provided at its upper end with the shouldered portion 88, this portion having a flat upper surface 90 and inner opening 92. The container wall extends upwardly to produce the sloping upper rim 94, to which is either attached or integrally molded the inwardly extending ring 96.

Container 86 is made of the same kind of plastic as in the FIG. 1 embodiment, and ring 96 may also preferably be made of the same kind of plastic. The inner diameter of the ring 96 is, as in the previous embodiment, made larger than the diameter of the opening 92. Its diameter is just slightly larger than the diameter of the disc 24 of the closure member. Therefore, ring 96 serves the same purpose as inwardly extending flange 16 of the above first embodiment.

The FIGS. 5 and 6 embodiment operates the same as the FIGS. 1–3 embodiment.

The FIGS. 5 and 6 embodiment operates the same as the FIGS. 1–3 embodiment.

A suitable cover, similar to the cover 80, but sized accordingly, is to be provided for the container of FIGS. 5 and 6.

Referring now to FIGS. 7–9, a third embodiment of the invention is provided. In this instance, an outer container indicated generally by numeral 100 is provided, which is preferably square or rectangular in shape. It has, accordingly, the four upstanding walls 102, 104, 106 and 108. (See FIG. 8) A bottom 110 is provided. The container 100 is preferably molded out of strong durable plastic such as the material used in the FIG. 1 embodiment. The upper rim of the walls flares upwardly and outwardly and then bends downwardly to provide a flanged rim 112 on the container.

Near the upper edge of the wall 106 are attached, by suitable means such as screws, a pair of hinges 114 mounted on bases 115 to offset the hinges from wall 106 and thus clear rim 112. The movable leaves of the hinges are attached to a cover indicated generally by numeral 118, the attachment thereto being conventional in all respects.

The cover 118 comprises a rectangularly-shaped skirt portion matching the shape of the receptacle 100 and comprising the downwardly extending side walls 120, 122, 124 and 126. An inwardly turned flange 128 is provided at the upper open part of the skirt and suitably fastened to this by means of proper adhesives (or by screws if desired) is a transparent rigid sheet material member 130 of molded synthetic resin plastic having an opening 132 approximately at its center. Opening 132 has a perimeter made by forming the plastic edge to provide an upwardly extending lip 134 to prevent the transparent cover from being made opaque by sliding contact of disc 24 therewith. Similarly, the lip 132 turns downwardly far enough to prevent contact between upper surface of disc 28 and the underside of cover 130.

The sidewalls of the cover 118 extend downwardly, as indicated above, and attached to the lower rim of the sidewall 120 are the aforesaid hinges 114. The opposite sidewall 124 of the cover, when the latter is closed, rests against the upper edge of the sidewall 108.

In the closed position, it will be observed that the disc 24 overlies the opening 132 and covers a portion of top 130. When closure element 22 with its ball and socket seal and ram 50 is placed over opening 132, it will be in position to permit usage of the ram to compact material placed in the outer receptacle 100. Further, a disposable container 136 fits inside the container 100. If the latter is rectangular in shape, then container 136 preferably should be rectangular in shape in order to fit reasonably closely against the walls of the container at the bottom end. (However, if container 136 is a plastic bag, it does not necessarily have to conform to the shape of the outer holder. See FIG. 15 and its description.) The top end of the disposable container is spaced from the walls of the holder 100 thus providing a given amount of draft between the walls of the outer receptacle and the container to facilitate withdrawal of the container from the receptacle.

If container 136 is made of collapsible material such as a paper or plastic bag, means may be provided to prevent the bag from collapsing (for convenience sake), and also means need to be provided to prevent the rupture of the bag during use. Accordingly, a liner 138 is provided, being made of high density polyethylene material, as an example of material which may be used. The liner is in two parts, an upper part 140 and a lower part 142. These parts are so fashioned that the upper part 140 is wider at its top portion than at its bottom; and the lower portion is wider at its bottom than at its top. The lower edge of the upper portion 140 and the upper edge of the lower portion 142 are sized to be joined together as shown, the juncture being made conveniently by means of a nut-and-bolt arrangement.

The upper rim 144 of part 140 flares outwardly and upwardly as shown, and rests against the outwardly turned flange 112 of the receptacle 100. In order to fasten the liner thereon, a catch 146 made of spring metal is provided on the edge opposite hinges 114 which reentrantly hooks down over the downwardly turned flange 112 on wall 108. (The reentrant engagement prevents the liner from freely moving upwardly during use.) Catch 146 may be attached to the upper edge of part 140 by conventional means such as riveting.

The bottom portion 142 of the liner terminates just short of the bottom 110 of the outer holder or receptacle.

In respect to this embodiment, the prevention of lateral movement of the disc 24 sufficiently to uncover any part of the opening 132 is assured by providing that the relative lateral dimensions of the collar 34 and opening 132 are such that the periphery of collar 34 will engage the edge of opening 132 before the oppositely positioned rim portion of disc 24 moves far enough to open a passageway into the interior of the container.

Referring now to FIG. 10 for a fourth embodiment, it is like FIGS. 7–9 except that the wall 148 of the cover is a modification of wall 124, in that the lower rim 150 of this wall flares outwardly more than does the lower rim of wall 124. In this embodiment, means are provided for holding the cover onto the basic receptacle by means of a catch member 152 which is attached to the lower rim 150 by conventional means such as screws as shown. A detent member 154 is attached to the wall 108 of the receptacle itself in position to be engaged by the catch when the cover is in the closed position. While not shown in FIG. 10, a liner like liner 140 is provided and extends over the upper edge of the receptacle 112. Also, in this embodiment, the catches 146 are two in number and are moved to the sides 102 and 104 of the liner.

The operation of the FIGS. 7–10 embodiments is like that of the FIGS. 1–6 embodiments except for one matter:

It will be noted that previously described flange 37 is slightly smaller in diameter than the inner diameter of the rim 132. As a result of this, in order to remove the total assembly of closure member 22 from the cover 130, the former must be centered within the diameter of the ring 132. Thus, the cover member 24 can move laterally during compaction of material in the disposable container 136, but in order to move the closure assembly from the cover 130, centering must be done just as in the previous embodiments. However, it is to be noted that the separation between discs 24 and 28 is to be just slightly greater than the vertical extent of the lip 134.

A further feature of the FIGS. 7–10 embodiments is as follows: To put trash into the container for compaction, the covers are lifted to their upright position (on hinges 114). In these embodiments, it will be noted that this can be done without removing the closure element 22 with its ram from the cover, and the cover will be held in stable upright position by the ram. The smooth sliding fit of the ram 52 in the ball 40 will permit the cover to be opened, the ram sliding in the ball 40 as the cover is pivoted on its hinges to an open position.

Referring now to FIG. 12, a fifth embodiment of the invention is shown, this embodiment involving a different method of constructing the impacting tool or ram for the system. The ram in this case comprises the tubular handle 50 as in the previous embodiments, and the shaft 54 which is used (by thrusting it down within the handle) to strike the interior face of the plate 158. The handle 50 flares outwardly at its end as shown by numeral 64 (preferably in the shape of a cone) and a retainer member 156 is used to hold the plate 158 on the handle 50.

The retainer means 156 comprises, in this embodiment, an outer generally hollow, bell-shaped shell, preferably cone-shaped, which surrounds the flared end 64 of the handle.

An interior tubular sleeve 160 is shown, preferably as an integral part of the shell 156, which is tapered in order to match the taper of the outwardly flaring end 64 of the handle 50. As indicated, the sleeve 160 is formed as an integral part of the outer shell 156. If desired, however, (although it will be more expensive) the sleeve 160 may be attached suitably to shell 156 as by welding. It is preferred that the entire structure 156 and 160 be a unitary piece formed by a stamping operation.

The outermost end of the shell 156 is larger in transverse directions than the inner end 162 where the latter meets the handle 50, and receives the plate 158. The rim 164 of the shell 156 is folded inwardly (as shown) against the peripheral portion of the plate 158 in order to hold and lock the latter against the outermost end of the flared portion 64 of the handle, and thus also to lock the shell 156 (because of the taper 64 and the sleeve 160) in position at the end of the handle 60.

The operation of the FIG. 12 device is the same as that of the previous embodiments.

Figure 13:
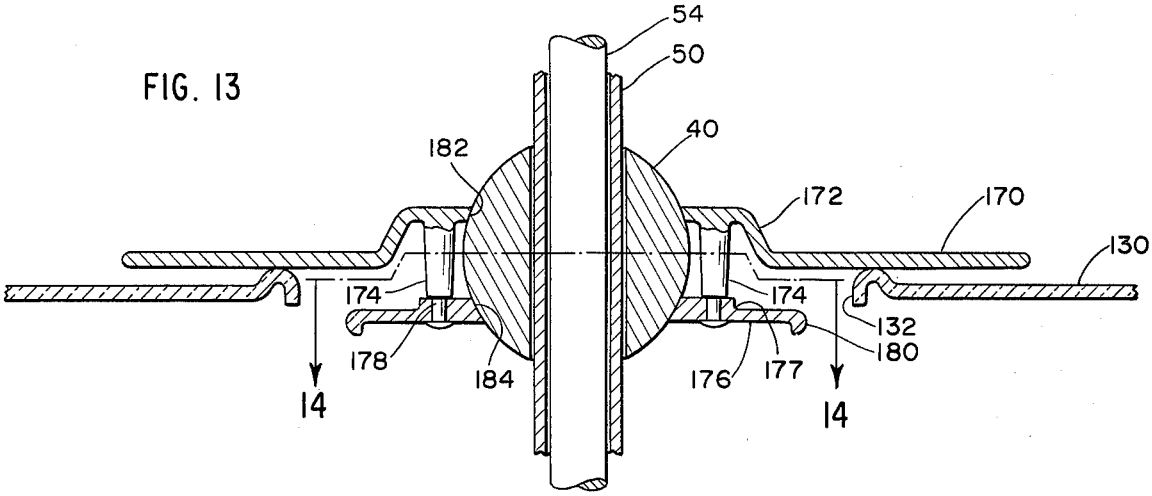
FIG. 13 is a cross-sectional elevation of a portion of a sixth embodiment of the invention.
Figure 14:
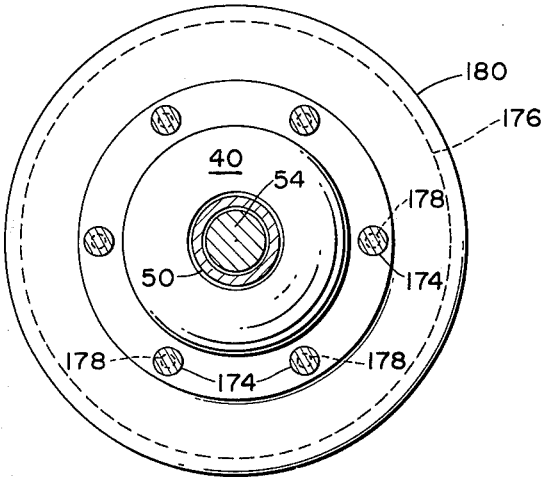
FIG. 14 is a bottom plan view of a portion of the sixth embodiment taken in the direction of sight lines 14—14 on FIG. 13.

Referring now to FIGS. 13 and 14, a sixth embodiment of the invention is shown, the embodiment being directed particularly to a method of fastening the inner retainer disc to the outer closure element; and a more economical way of forming a socket to receive the ball of a device.

A closure element or shield 170 is shown, analogous to, but different from, the shield 24 and serving the same purpose as the latter. Boss 172 is provided therein from which depends a plurality of posts 174. In the drawing, six posts are shown (see FIG. 14), but fewer may be used if desired. However, no fewer than three should be used. Of course, more than six may be used if desired. The posts 174 are molded as integral parts of the boss 172. As so molded, the posts form a supporting structure or cage for a plate 176, which becomes the lower retainer disc. The attachment of the disc 176 to the posts 174 is by providing suitable shoulders on the latter, and providing suitable holes in the disc which will fit over the extending ends of the posts. Thereafter, by suitable heating means such as the use of ultrasonic staking or by the application of heat, the ends of the posts are deformed in order to lock the disc 176 securely on the posts. The outer rim 180 of the disc 176 is curved downwardly as shown to impart rigidity to the disc, and also to provide a smooth edge for piloting the disc down into the hole 132 in the cover 130.

The upper surface of boss 172 is provided with an opening 182 which preferably is chamfered on its inner surface as shown. The chamfer may have a flat surface, but preferably will have the same radius of curvature as the ball 40 in order to fit on the latter. Disc 176 is also provided with a hole having an arcuate inner chamfer 184 of the same radius of curvature as that of the ball 40.

To assemble the device, the ball is inserted within the cage formed by the posts 174, disc 176 is then mounted over its post, and the ends 178 of the posts are then heat-deformed in order to hold the disc on the post. As a result of this, the ball 40 is held between the oppositely disposed arcuate rims 182 and 184 of the holes in the boss 172 and in the disc 176.

The operation of the embodiment shown in FIGS. 13 and 14 is the same as the previous embodiments, but its construction is more economical.

The shield disc or cover 170 is prevented from moving laterally so far as to expose an opening into the container itself during compaction (of, for example, glass) by the engagement of the posts 174 against the rim 132 of the cover member 130. This is one of the reasons for using a plurality of posts 174, such as six instead of a minimum quantity such as three. Or, if desired, a peripheral shoulder 177 may be provided on disc 176 to act as a lateral stop.

Figure 15:
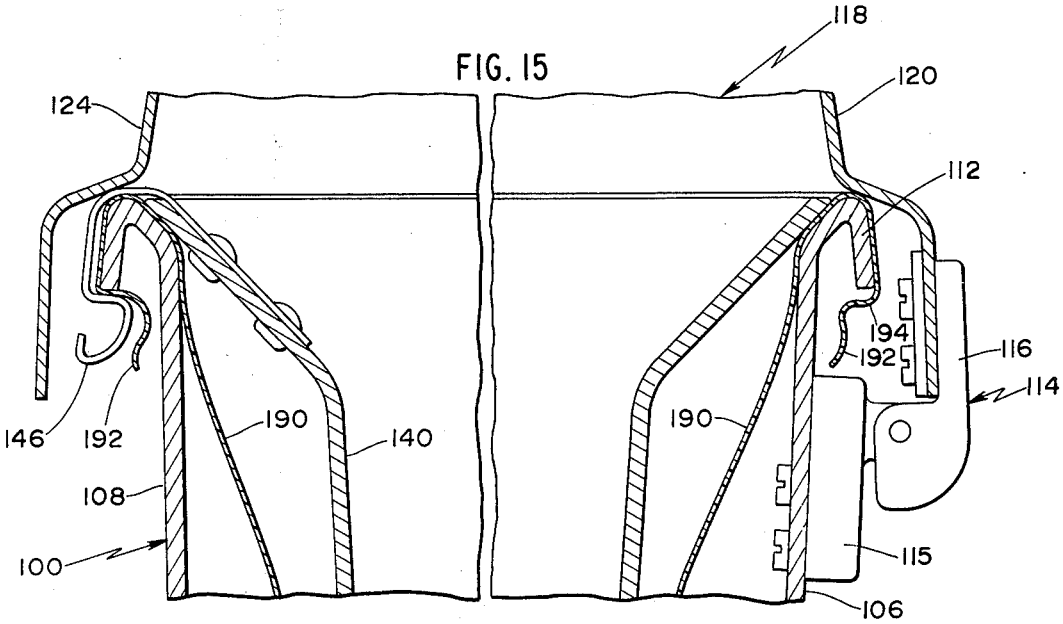
FIG. 15 is a cross-sectional elevation of a seventh embodiment of the invention.

Referring now to FIG. 15, a seventh embodiment of the invention is shown, which is like the embodiment shown in FIG. 7, except that it uses a different kind of throw-away or disposable container. In the embodiment, it is intended that a plastic bag be used instead of the disposable container 136. The outer container 100 is provided, as in the FIG. 7 embodiment, and has hinges 115 at one side thereof. Cover 118 is provided together with the closure disc 24 (not shown) as is provided in FIG. 7. Liner 140 is provided which fits down over the outwardly and downwardly turned edges of the side walls 102–108 of the outer container.

As indicated above, in this embodiment a plastic bag 190 is used instead of the disposable container 136 of the FIG. 7 embodiment. However, the plastic bag 190 is so dimensioned that it is necessary to stretch its upper edge in order to fit it over the outwardly and downwardly turned upper rim of the walls of the outer container. When the bag is thus stretched over the rim, and then released, it will be observed that its natural elasticity will pull the outermost edge portion of the bag inwardly, and this will hold the same securely over the edges 112 of the outer container.

After the bag is thus attached, the liner 140 is then inserted as in the previous embodiment and serves to protect the plastic bag from rupturing.

It will be noted that because of the offset of the hinge 115 from the wall 106 of the outer container, there will be room for the edge of the bag to fit down into the space 192 provided by the offset. In view of the fact that bags which are commercially available for receiving trash are made of a rather slippery polyethylene or polypropylene material, it will be found that even though the upper rim of the bag is a fairly tight fit around a continuous smooth rim of a container, the upper edge of the bag will normally tend to slide inwardly and fall downwardly in the container. However, one of the features leading to the desirability of the outwardly and downwardly extending lips or edge 112 of the container is that because of the discontinuous construction, the outside edge of the bag is enabled to retract inwardly toward the walls of the outer container. The bag thus grips the upper edge of the container, and the bag is thus held securely in a non-slip arrangement.

Thus, in all of the embodiments, means are provided on at least one of either the container or the closure member itself, to prevent removal of the latter from the container unless each is centered with respect to each other.

In view of the above it will be seen that the several objects of the invention are achieved and other advantageous results attained.

It is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

As many changes could be made in the above constructions without departing from the scope of the invention, it is intended that all matter contained in the above description or shown in the accompanying drawings, shall be interpreted as illustrative and not in a limiting sense, and it is also intended that the appended claims shall cover all such equivalent variations as come within the true spirit and scope of the invention.

Having described the invention, what is claimed is:

1. A receptacle for material to be compacted having, in combination, a hollow holder, a closure member therefor of essentially rigid material, and a ram:

the holder having an opening at the top; the closure member overlying the opening to close the same, and having a swiveled sealing aperture therethrough; the ram comprising a first portion rotatably, longitudinally and sealingly slidable within the aperture and a second portion for placement upon the material to be compacted, said first portion being swiveled, and rotatably and longitudinally movable relative to the holder; and means on at least one of the holder and the closure member for preventing removal of the latter from the holder unless approximately centered thereon; the ram and the closure member being freely removable from the holder as a unit when the closure member is so centered.

2. The receptacle of claim 1 in which the closure member including a portion of a predetermined cross-sectional shape, and the upper edge of said holder provides an opening of the same predetermined cross-sectional shape but slightly larger than the first cross-sectional shape, whereby to remove the closure element from the holder, the closure element must be centered with respect to said upper rim or edge.

3. The receptacle of claim 1 in which said closure element includes a disc of rigid sheet material, and said means for preventing removal of the closure element from the holder comprises an inwardly extending flange on the upper edge of the holder slightly larger than the said disc, whereby said disc must be centered within said flange in order to remove the closure element from the container.

4. The receptacle of claim 1, including a cover having a hole approximately in the center thereof and overlying the interior thereof, and said closure element includes a first disc overlying said hole and being greater in area extent than said hole, and the means for preventing removal of the closure element from the cover comprises a second disc member dependent from the first disc member and having a diameter slightly smaller than said hole.

5. The receptacle of claim 4 in which the swiveled sealing aperture comprises a ball and socket joint, the ram being adapted to slide and rotate within the ball of the ball and socket joint.

6. The receptacle of claim 5 in which the ball and socket joint comprises a collar fastened to the top disc and having at its lower extremity said second disc.

7. The receptacle of claim 4 in which the swiveled sealing aperture comprises a first hole in said first disc, a second hole in said second disc, a ball rotatably positioned between said first and second discs and being larger in diameter than either of said first and second holes, and a plurality of posts mounting said first and second discs in spaced apart relationship.

8. The receptacle of claim 1 in which the said first portion of the ram comprises a hollow tubular handle, said second portion comprises an enlarged head at one end of the handle, and includng a shaft slidable within said handle and of such length as to strike the interior of said enlarged head upon being thrust down into the handle.

9. The receptacle of claim 1 including a cover hinged thereto, the cover being provided with a hole at its center, and said closure member comprising a disc overlying said hole and of a diameter greater than said hole, the swiveled sealing aperture comprising the ball of the ball and socket joint fastened to said disc, the ball having a hole therethrough; and the first portion of the ram being a tubular shaft which is rotatably, longitudinally, and sealingly slidable within the hole in said ball.

10. The receptacle of claim 9 in which said cover is adaptable to be tilted upwardly to open the container without removal therefrom of the closure member and ram, the latter both sliding and pivoting with respect to the cover as the latter is opened.

11. The receptacle of claim 1 including a liner therein, the liner being adapted to fit within an inner disposable container within the receptacle, the liner comprising two sections each tubular and meeting at the lower edge of the top section of the upper edge of the lower section being fastened theretogether, the upper edge of the first section being flared outwardly and resting on the upper edge of the walls of the receptacle, fastening means comprising a spring clip overlying the edge of one of the walls of the receptacle to hold the liner in place.

12. The receptacle of claim 11 in which the cover is hinged at one side thereof to the holder and the other side overlies said spring clip for the liner.

13. A tool for crushing material comprising:

a tubular hollow handle, one end portion thereof flaring outwardly to form a bell-shaped portion as a lower extension of the handle;

a hollow retainer member attached to and surrounding said bell-shaped portion, the retainer member comprising a hollow outer bell-shaped shell larger in diameter than the diameter of the handle and flaring outwardly so that its outermost end is larger than inner end where it meets the handle; the member having an inner hollow sleeve as a part thereof adapted to fit over and seat on the bell-shaped extension of the handle;

a plate of larger diameter than said handle and lying transverse to the axis thereof against the outermost end of the bell-shaped portion of the handle;

means attaching the plate to the hollow container member, thus locking the plate and the retainer member in engagement with said bell-shaped portion; and a shaft slidable within said handle, the shaft being of such length that when thrust to its innermost position its inner end is adapted to strike said plate, and its outer end lies outside the handle for grasping.

14. The tool of claim 13 in which the means for attaching the plate to the retainer member comprises rim portions of the retainer member folded over against the peripheral edge portion of the plate.

15. The tool of claim 13 in which the means for attaching the plate to the retainer member comprises screws projecting through edge portions of the plate and threaded into bosses provided on the interior wall of the retainer member.

16. The tool of claim 13 in which the said inner sleeve is an integral part of the retainer member.

17. The tool of claim 13 in which said bell-shaped portion, said retainer member, and said inner hollow sleeve are each cone-shaped.

18. The receptacle of claim 1 including means on the upper rim of said holder comprising a protuberance having an outer portion extending beyond the walls of the holder and then being reentrant at the lower wall portion of the protuberance toward the walls of the holder; whereby when the upper edge portion of a bag of elastic material is stretched over the protuberance and extends downwardly beyond said lower wall, said edge portion will contract to hold the bag to said first edge portion of the holder.

19. The receptacle of claim 1 including a disposable container within the holder; means on the upper rim of the holder comprising a protuberance having an outer portion extending beyond the walls of the holder and then being reentrant at the lower wall portion of the protuberance toward the walls of the holder; the disposable container comprising a bag of elastic material, the upper edge portion of the latter being stretched over said protuberance and extending downwardly beyond said lower wall portion; whereby said upper edge portion is contracted to hold the bag to said first edge portion of the holder.

* * * * *